US007780249B2

(12) United States Patent
Cianetti

(10) Patent No.: US 7,780,249 B2
(45) Date of Patent: Aug. 24, 2010

(54) DUAL MOTION OPENING SYSTEM FOR DISPLAYING UNITS

(75) Inventor: Alessandro Cianetti, San Pier d'Iosonzo (GO) (IT)

(73) Assignee: N.E.M. Nord Est Meccanica S.N.C., San Pier d'Isonzo (IT)

( * ) Notice: Subject to any disclaimer, the term of this patent is extended or adjusted under 35 U.S.C. 154(b) by 506 days.

(21) Appl. No.: 11/794,235

(22) PCT Filed: Dec. 22, 2005

(86) PCT No.: PCT/IT2005/000758

§ 371 (c)(1),
(2), (4) Date: Jun. 27, 2007

(87) PCT Pub. No.: WO2006/070428

PCT Pub. Date: Jul. 6, 2006

(65) Prior Publication Data

US 2008/0000860 A1 Jan. 3, 2008

(30) Foreign Application Priority Data

Dec. 29, 2004 (IT) ..... TS2004A0012

(51) Int. Cl.
*A47B 97/00* (2006.01)

(52) U.S. Cl. ..... 312/139.1; 312/137

(58) Field of Classification Search ..... 312/114, 312/116, 137, 138.1, 139, 139.1, 139.2, 140.4; 62/246; 49/209, 210, 246, 247, 248
See application file for complete search history.

(56) References Cited

U.S. PATENT DOCUMENTS 4,479,622 A * 10/1984 Howse ..... 244/129.5
6,758,539 B2 * 7/2004 Cianetti ..... 312/139.2

FOREIGN PATENT DOCUMENTS

| | | |
|---|---|---|
| DE | 44 38 610 | 5/1996 |
| DE | 101 07 471 | 9/2002 |
| EP | 0 231 498 | 8/1987 |
| EP | 1 293 153 | 3/2003 |

* cited by examiner

*Primary Examiner*—James O Hansen
(74) *Attorney, Agent, or Firm*—Dowell & Dowell, P.C.

(57) ABSTRACT

The system foresees for each plate (1) an autonomous mechanical structure composed of one section bar (3) connected to a gripper that holds a plate (1) as well as of another section bar (10) and at least two support arms (5, 5', 6, 6') hinged upon said section bars (3, 10); the structure is fixed to a section bar (9) that is in turn fixed to the display counter or window near the base of the tank; the support arms (5, 5', 6, 6') differ in length; two supports (4, 4', 11, 11') are fixed to each section bar (3, 10); said supports constitute the hinge members upon which the ends of the support arms (5, 5', 6, 6') fit; each plate (1) can both move in a parallelogram motion with translation parallel to the display counter or window, and open like a casement window using the pin (7) of the shorter support arm (5, 5') as a pivot; the system also contains a spring closing mechanism and a lock (18).

13 Claims, 6 Drawing Sheets

DUAL MOTION OPENING SYSTEM FOR DISPLAYING UNITS

FIELD OF APPLICATION

The system in question is used particularly in the refrigerated display units sector, but can also be used for heated and ambient display counters, as well as for displays of any kind of goods, ranging from jewelry to clothes, to telephones, and so on.

STATE OF THE ART

Display units for the sale of foodstuffs and non-foodstuffs always contain plates made of glass or plastic material. Their function is that of isolating products from the surrounding environment and/or ensuring customers do not remove those products. The plates are attached in a manner of ways either to a frame above them, which is supported by uprights, or to a frame below them, which is in turn fixed to the display counter or window.

A number of systems exist for moving plates that are attached to a frame below them. One of these systems is described in the Italian proposal N° TS2001A000022, which foresees the longitudinal translation of the plates, no matter how many, along the customer side of the counter. This translation is accompanied by the rotation of each plate as it is fixed to a section bar that is hinged between two support arms for another supporting section bar placed below. A mechanical structure with a parallelogram motion is thus achieved. A piece of elastic equipment is attached to the support arms. Other patents, such as the German patents Nos 196 39 661 and 44 38 610, describe systems with parallelogram motion to be used in other sectors of technology.

The system described in the Italian proposal N° TS2001A000022 is extremely efficient, but unfortunately falls short when it comes to moving plates of certain thicknesses (ranging from 6 mm to the thickness of double plates/double-glazing) and sizes, spherical or curved plates, and cone frustum plates. As is well known, the term "spherical" denotes here a plate that is curved both lengthways and crosswise, and thus takes on the shape of part of a sphere. The term "curved", however, denotes a plate that is only curved crosswise, whereas the term "cone frustum" denotes a plate that is only curved lengthways. When dealing with these kinds of plates, manual support is required once they are open so as to avoid breakage of the hinges upon which the support arms are pivoted, and thus upon which the plate itself pivots—it is therefore unstable throughout. Operators are, therefore, obliged to make a constant effort in order to carry out the daily tasks of cleaning and inserting/removing goods for two reasons: to support the plates, and to move with difficulty between the open plate and the display counter or window. Furthermore, to add to operators' problems, no opening systems have yet been devised for plates of a certain size, and especially not for shaped plates.

SUMMARY OF THE INVENTION

The invention here discussed has the object to provide users with a system that allows heavy plates to be moved without putting operators in any danger.

Another aim of the invention is to allow for both vertically and horizontally non-linear plates to be moved.

The first claim is that these aims, amongst others, are achieved by the system in question. In short, this system foresees the construction, for each plate, both single or double, of a mechanical structure that is composed of a section bar attached to the plate, of another section bar that is connected to the display counter, and by at least two support arms that differ in length, which are hinged to those section bars.

The two support arms that differ in length, in conjunction with the two section bars, form a dual opening system that foresees, for each plate, both a parallelogram motion with translation parallel to the display counter or window, and also a casement opening system.

The plate is either fixed directly to the first section bar, or it is fixed to a gripper that is in turn fixed to the section bar. The second section bar is either fixed directly to the display counter or window, or it is fixed to another section bar, which in turn is fixed to the display counter or window and is intended to support the whole mechanical structure.

Section bars are fixed above and below the section bar that is fixed to the display counter or window. Such section bars can be built in a single piece. Inserts for electrical resistors are built into the top section bar. The part of the top section bar that faces the plate accommodates the base of a gasket. The part of the bottom section bar that faces the gripper accommodates the base of another gasket. The presence of these two gaskets, which ensure the plate is always firmly sealed in, means that the cold air that circulates constantly in the lower part of the cabinet, in the case of a refrigerated display counter, cannot escape.

The direction of each plate's translation motion is determined by the direction in which the longer of the two support arms are fixed, and its rotation on the pin facing the outside of the shorter support.

Preferably, the system should be used for curved, spherical (both concave and convex), and cone frustum plates, in that the section bars upon which the support arms are hinged can be curved to any angle and the whole structure will still function. The support arms can also be straight or curved. If the latter is true, the arms will be paired with curved section bars. Their bend radius matches that of the section bars they rest upon when not in use.

The weight of each plate rests on the bottom supporting section bar, which is called into use a lot when the plate is open. This is the case with usual opening systems that open down the way, but here the support arms mean there is no need to support it.

The two section bars pertaining to each plate are built separately and connected to the support arms upon assembly within the factory. This means that display counter producers can be provided with individual parts, and can thus assemble their counters and choose the direction in which they wish each plate to open. Indeed, each plate can open either to the left or to the right as one faces the display counter from the customer side depending on how the mechanical structure is assembled, taking into account that the direction of the plates' translation motion will be determined by the direction in which at least one of the longer support arms is facing. Where there are several plates alongside each other, the producer can choose the direction in which they move, whether it be left for some and right for others, or the same direction for all.

Another advantage worth mentioning is that if at some point the venue in which the display counter or window is used undergoes refurbishment that requires the plates to open differently, each mechanical structure can be removed and then replaced turned backwards on the display counter or window, so that the plate will then open in the opposite direction.

Thanks to the dual translation-rotation motion of each plate that this opening system foresees, access to the display area and to the internal part of the plate is simplified, thus facilitating its cleaning.

The use of a lock placed in the lower part of the system, which joins the mobile part of the mechanical structure to the immobile supporting part that is fixed to the display counter, ensures that the various parts are securely in place, thus is avoiding the plate shifting. It also guarantees that the gaskets between the plate and any possible uprights, as well as those between the mobile and supporting immobile parts of the counter, are firmly in place. The lock also has an important security function, in that it avoids the plate being opened accidentally, or even deliberately to steal the goods displayed.

The opening system here discussed also comprises a spring closing mechanism involving a pin that is fixed to the section bar that is connected to the plate, and has a spring wrapped around it, that fits into a bush fixed onto the section bar that is attached to the display counter or window. This closing mechanism allows the two section bars to be aligned when the counter is completely closed, and therefore to adjust the plate to its correct position, and to always position all of the mobile parts in the same place, thus avoiding any bending under the weight of the plate, any structural bending, or any incorrect construction or assembly. The motion system here discussed permits display counters or windows to be constructed with the upper part free of any framework or finishing, thus making the product on sale more visible. Naturally, however, nothing prevents the display counters or windows later being fitted with uprights to support the middle shelving or to support extra lighting devices for the products.

Given that all the mechanics are contained within the lower part of the display counter or window, the torsional forces exerted are greatly reduced, which means that lighter support frames (intended to support both the tank and the mechanical structure in question) can be used, thus lowering production costs.

BRIEF DESCRIPTION OF THE DRAWINGS

The features, objects and advantages of the present invention will become more apparent from the detailed description set forth below, when taken in conjunction with the drawings and wherein.

DETAILED DESCRIPTION OF AN EXAMPLE OF PREFERRED EMBODIMENT

Figure 1:
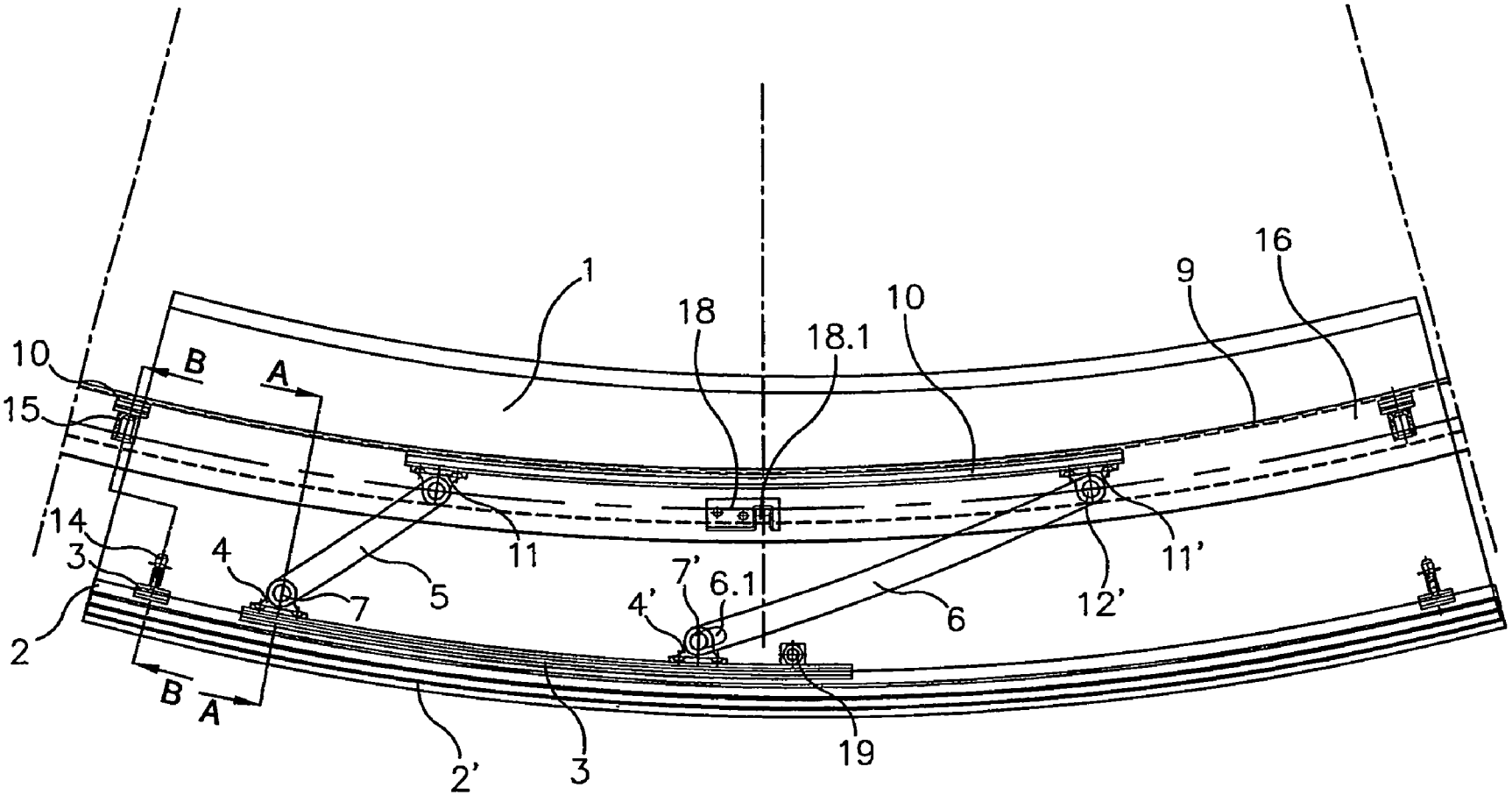
FIG. 1 illustrates a top view of a spherical plate connected to a display counter using the system according to the here discussed invention.
Figure 2:
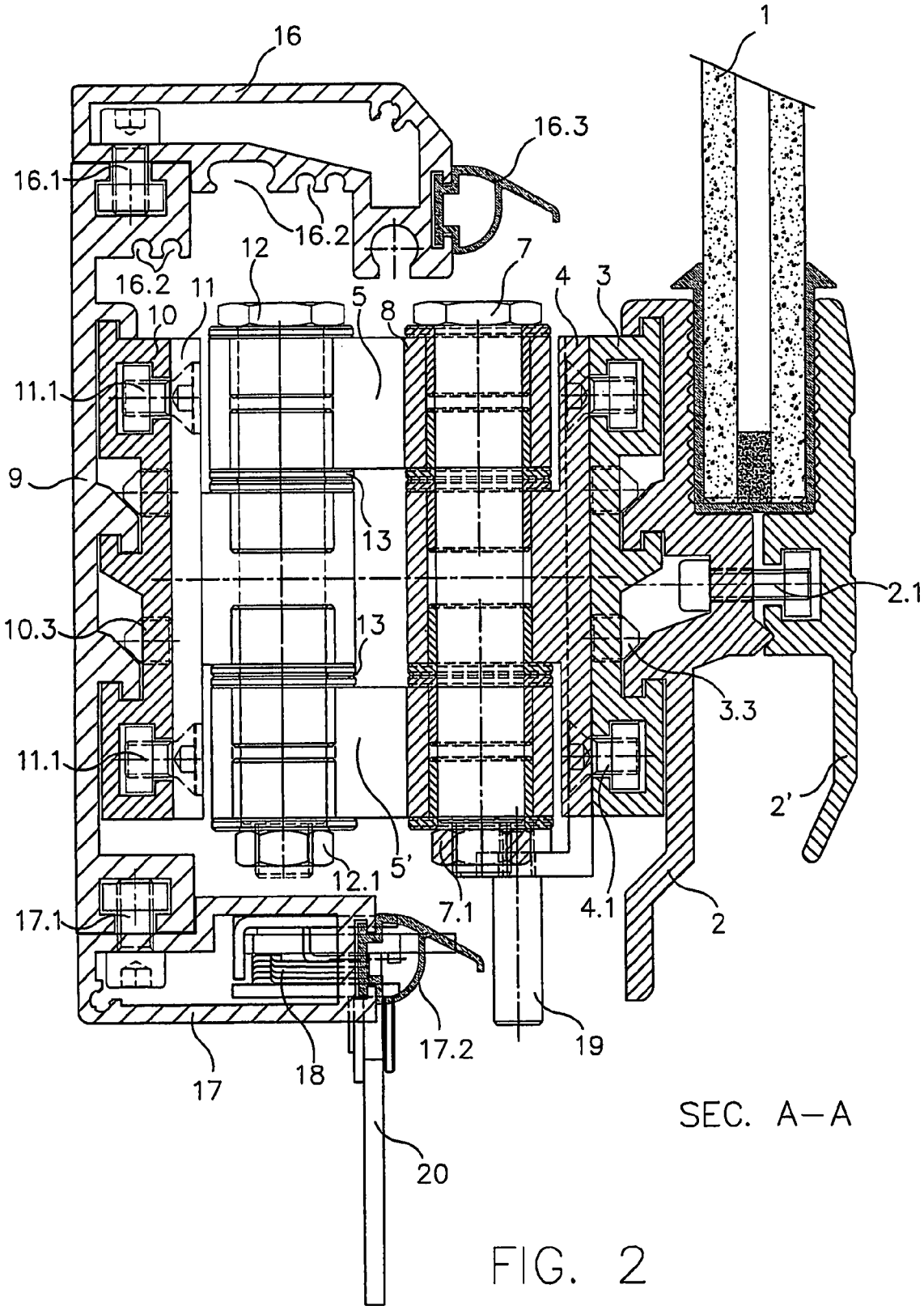
FIG. 2 illustrates, in more detail, a view of the section along the plane A-A of certain components of the system.
Figure 3:
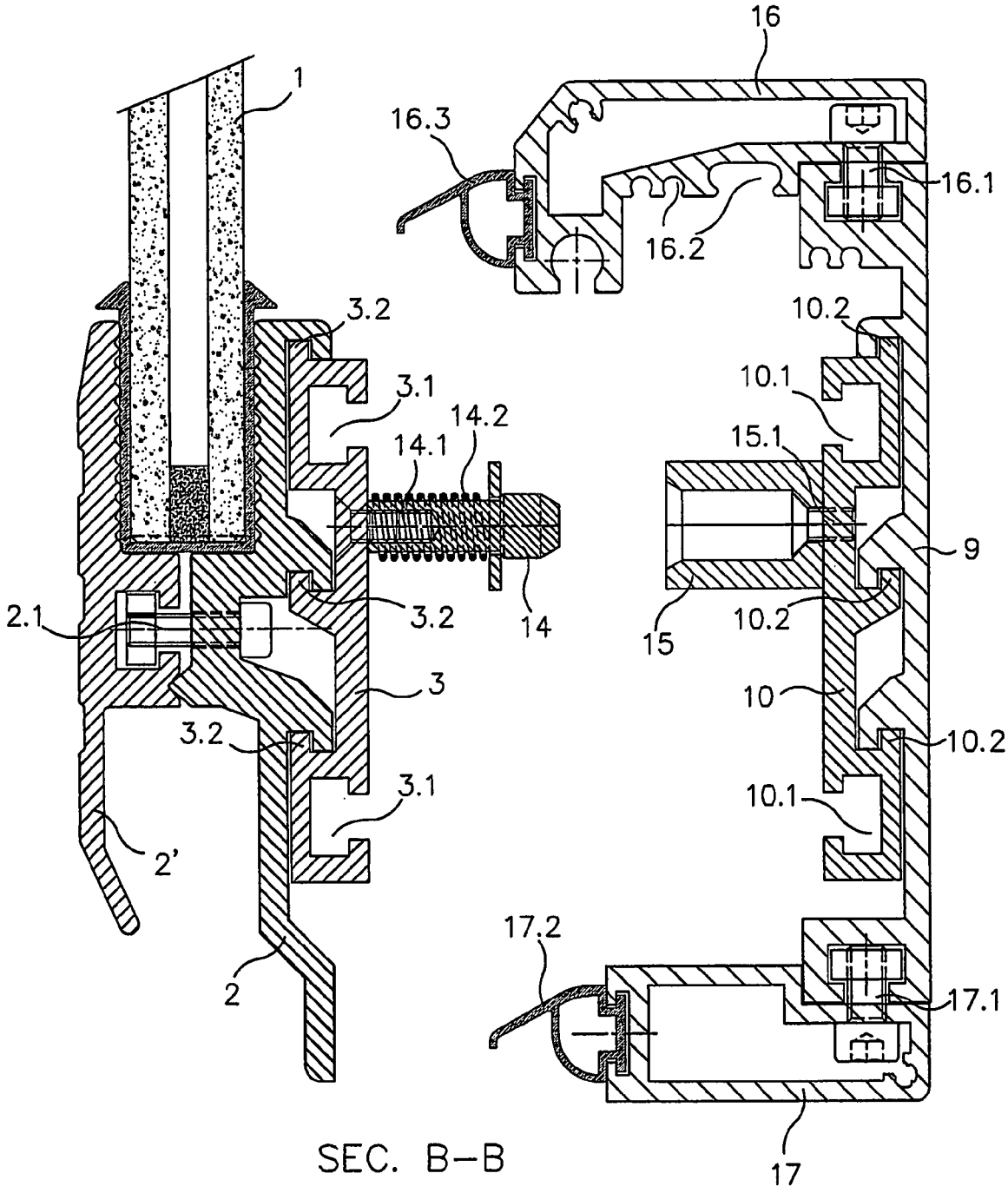
FIG. 3 illustrates in detail another section, along the plane B-B, of certain components of the system.
Figure 4:
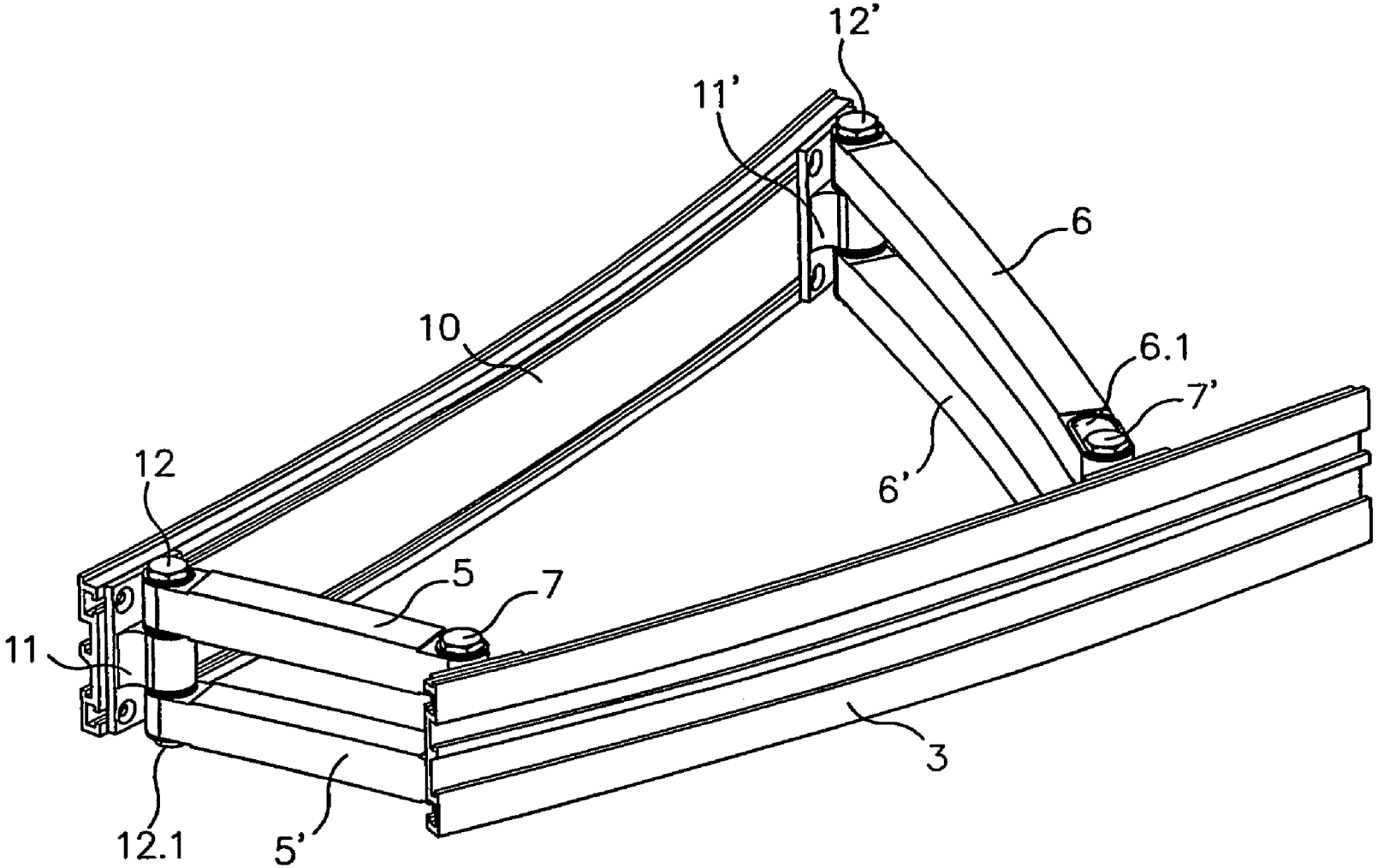
FIG. 4 illustrates a prospective view of the mechanical structure that constitutes the heart of the system.

The opening system according to the invention here discussed allows a double spherical glass plate 1, placed on the customer side, to be moved on a display counter.

The plate 1 is fixed to a gripper that is formed by two section bars 2, 2' and a bolt 2.1. The gripper is clamped onto the plate 1 by tightening the bolt 2.1 that joins the section bar 2', which points outwards, to the section bar 2, which points towards the display counter. A third section bar 3, which has guides 3.1 to fit square nuts placed along one of its sides and parallel to it, is fixed by a joint to section bar 2 that points towards the display counter. The opposite side of section bar 3 has teeth 3.2 on it. By tightening the screws 3.3 onto inclined planes created on section bar 2 that points towards the display counter, the teeth 3.2 on section bar 3 can be fully inserted into the guides on section bar 2, thus preventing the two section bars 2, 3 from becoming separated.

Two supports 4, 4' are screwed to the third section bar 3 using bolts 4.1, which have nuts that are inserted into the guides 3.1 on section bar 3. Those supports 4, 4' constitute the male hinges of two male/female hinges. The end of one support arm 5 and the end of another support arm 5' are hinged onto each support 4. The end of a third support arm 6 and the end of a fourth support arm 6' are hinged onto each support 4'. The ends of these couples of support arms 5, 5', 6, 6' constitute the female ends of the abovementioned hinges. One cylindrical pin 7 fastens the two support arms 5, 5' to one hinge, and another cylindrical pin 7' fastens the support arms 6, 6' to another hinge. These pins 7, 7' allow for the rotating motion of the support arms 5, 5', 6, 6' upon the supports 4, 4'. This rotating motion is eased by the fact that the support arms 5, 5', 6, 6' rest upon bronze bearings 8. A nut 7.1 is fixed to each pin 7, 7' to prevent it from slipping. The first and second support arms 5, 5' are shorter in comparison to the third and fourth support arms 6, 6'. Both the third support arm 6 and the fourth support arm 6' contain a feedthrough 6.1 near their end into which the pin 7' fits. The feedthrough 6.1 is wide enough for the pin 7' to slide into.

A fourth section bar 9 is fixed to the base of the display counter's tank, on the customer side. A fifth section bar 10, which has the same profile as section bar 3 and therefore also contains guides 10.1 to fit square nuts along one of its sides and teeth 10.2 along its opposite side, is fixed onto the abovementioned fourth section bar 9. Section bar 10 is the mirror image of section bar 3 when mounted.

Section bar 10 is fixed to section bar 9 by tightening screws 10.3 onto inclined planes created on section bar 9, permitting the teeth 10.2 of section bar 10 to fit completely into the guides on section bar 9.

Two supports 11, 11' are screwed to section bar 10 with screws 11.1 and nuts. Both the second end of the first shorter support arm 5 and the second end of the second shorter support arm 5' are fitted to the support 11 by a pin 12 that is blocked by a nut 12.1. Both the second end of the first longer support arm 6 and the second end of the longer support arm 6' are fitted to each support 11' by a pin 12' that is blocked by a nut. Here too the rotating motion of the support arms 5, 5', 6, 6' on the supports 11, 11' is assured by the fact that the support arms rest upon bronze bearings 13.

The plate 1 shown in the attached drawings and described above is spherical. All of the section bars 2, 2', 3, 9, 10 used are curved according to the bend angle applied to the edge of the display counter's tank (on the customer side). The support arms 5, 5', 6, 6' are also curved to the same angle as the section bars 2, 2', 3, 9, and 10 so that they rest upon them when the counter is not in use.

In conjunction with the section bars 3, 10, the four supporting support arms 5, 5', is 6, 6', coupled in pairs, form a mechanical structure whereby section bar 3 is mobile and section bar 10 acts as a support.

A spring closing mechanism is used in this opening system. The mechanism comprises a pin 14 that is fixed by a screw 14.1 to a crop of section bar 3, which in turn is fixed to section bar 2 of the gripper as described above. A spring 14.2 is wrapped around the pin 14. The pin 14 fits into a bush 15 that is fixed by a screw 15.1 to a crop of section bar 10, which is in turn fixed to section bar 9 as described above.

A section bar 16 and a section bar 17 are fixed above and below section bar 9 respectively. These section bars 16, 17 are fixed to section bar 9 by tightening bolts 16.1, 17.1 and nuts. Inserts 16.2 are built into the top section bar 16 to accommodate electrical resistors for managing any condensate formed within the display counter. The part of the top section bar 16 that faces the plate 1 fits the base of one gasket 16.3. The part of the bottom section bar 17 that faces section bar 3 fits the base of another gasket 17.2.

An insert is also made into the bottom section bar 17 to accommodate a lock 18. This lock comprises a slot 18.1 into which a pin 19 that is fixed to section bar 3 fits, and is then blocked via a catch system. The pin 19 is unblocked by operating a lever 20 that releases the lock's 18 catch mechanism.

The joining of the lock 18 and the pin 19 ensures not only that the section bar 2 of the gripper that points towards the display counter is constantly tight against the bottom gasket 17.2, but also that the plate 1 is constantly tight against the top gasket 16.3. This dual adhesion, which is unchanging, ensures that the cold air that is constantly contained within the lower area of a refrigerated display counter cannot escape, or similarly that the warm air cannot escape in the case of a heated display counter.

Figure 5:
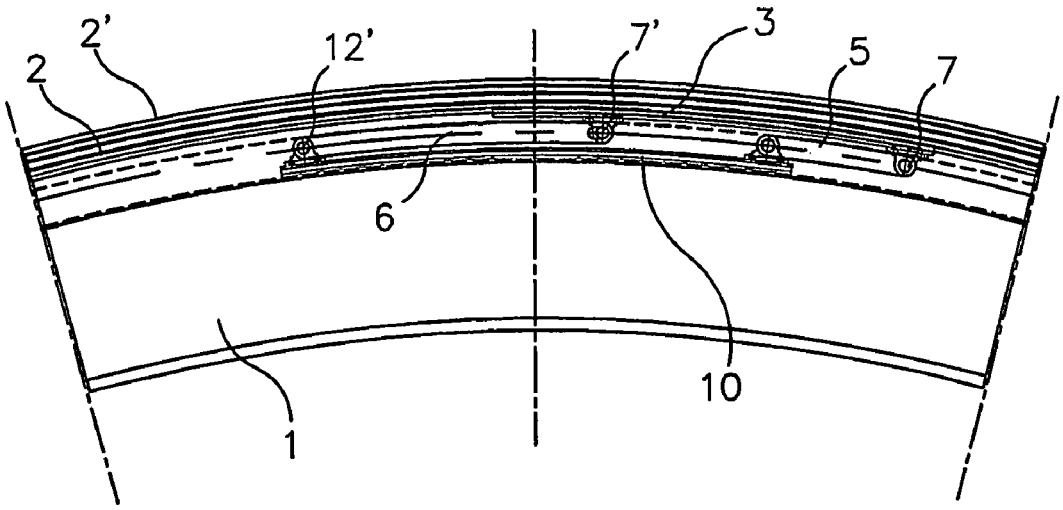
FIGS. 5, 6, 7 and 8 illustrate certain schematic top views of the various phases of motion of the plate.

When the plate 1 is not in use, as is shown in FIG. 5, it rests tightly against the two gaskets 16.3, 17.2. The pin 14 that is fixed to the section bar 3 is inserted into the bush 15 that is fixed to section bar 10 and the pin 19 is blocked in the slot 18.1 of the lock 18. The support arms 5, 5', 6, 6' are parallel to section bars 3, 10.

In order to move the plate 1 from its position one must first unblock the pin 19 from the lock 18 by means of the lever 20, thus deactivating the closing mechanism, which, thanks to the spring 14.2, maintains the plate 1 and the gripper that supports it at a distance of several millimetres from the gaskets 16.3, 17.2 to ease and guide the operator in carrying out the correct opening procedure.

Figure 6:
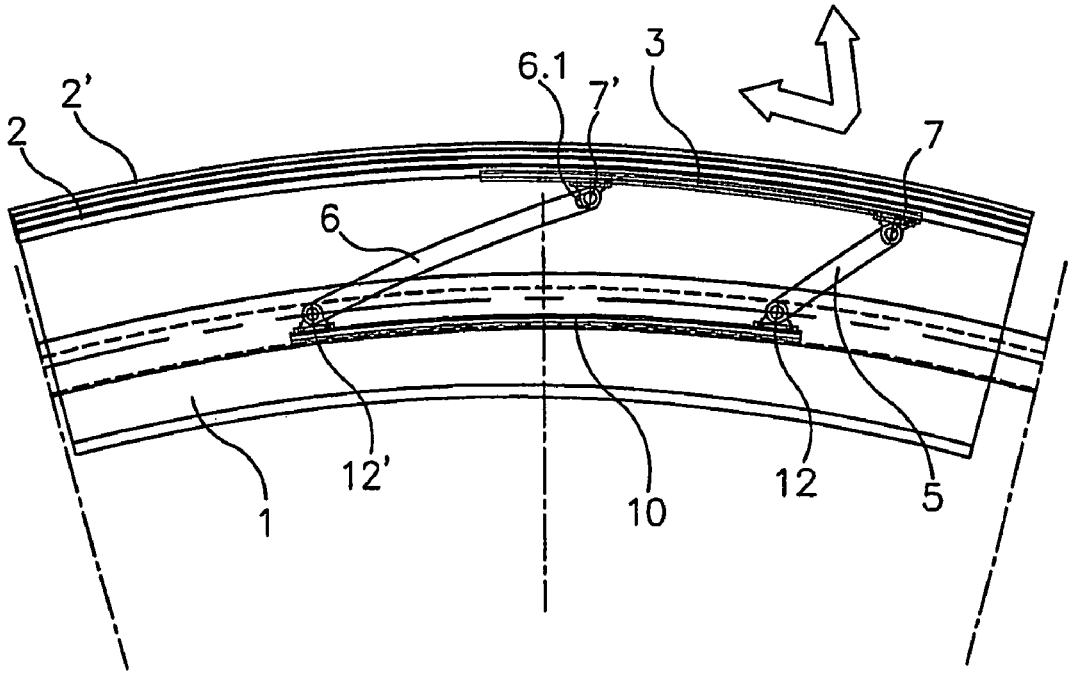

Next, one must take hold of the gripper, which is composed of the section bars 2, 2' and which holds the plate 1 in place, pull it towards the customer side, as demonstrated in FIG. 6, and at the same time push it towards the right as one looks at the display counter from the customer side. More specifically, the cluster plate 1—gripper—section bar 3 moves away from the display counter on the customer side and at the same time moves towards the right, parallel to the edge of the display counter, thus pivoting upon the two pins 12, 12' of the supports 11, 11' that are fixed to the bottom supporting section bar 10. The presence of the feedthroughs 6.1 on the support arms 6, 6' permits the cluster plate 1—gripper—section bar 3 to move more smoothly and avoids any complicated adjustments being made to the system to ensure that the mechanical structure does not get blocked. The maximum distance from the display counter that the cluster can reach during this phase corresponds to the distance between the interaxes of the pins 7, 12 that fit into the bottom support arms 5, 5'.

Figure 7:
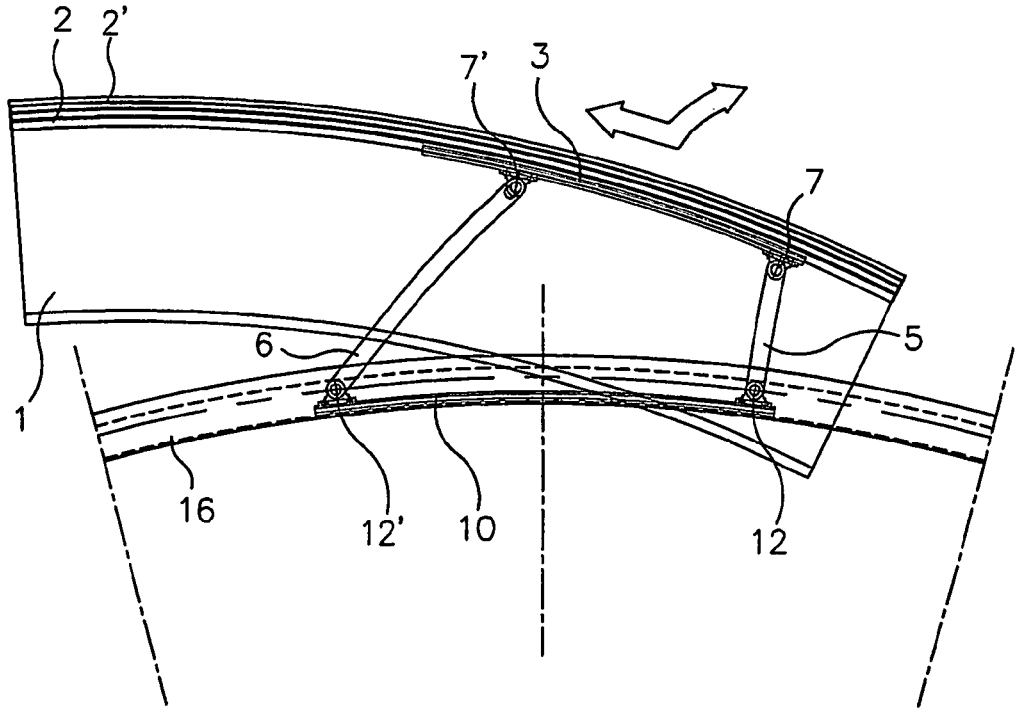

Next, as can be seen in FIG. 7, the cluster plate 1—gripper—section bar 3 opens outwards owing to the difference in length of the support arms 5, 5', 6, 6'. The bottom support arms 5, 5', which rest on the pins 7, 12 will hence complete a greater angular rotation throughout the entire opening phase and the casement opening will pivot on the pin 7 of the shorter support arms 5, 5'. The rotation motion will continue until it is halted or when the cluster has reached its widest opening angle.

Figure 8:
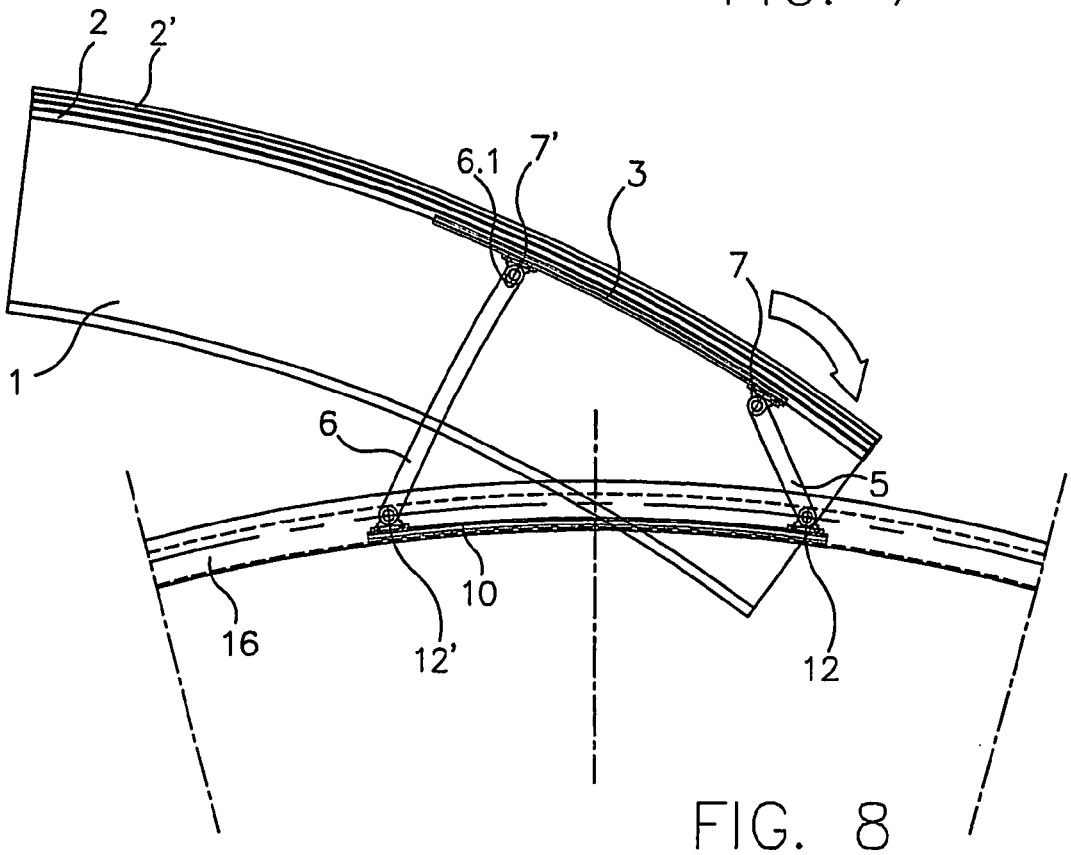

Thanks to this combined translation and rotation angle, when the plate 1 is completely open, as in FIG. 8, it will be at an incident angle and no longer parallel relative to the display counter, thus allowing the operator to have extremely easy access to the display counter's tank on the customer side and to then clean the tank itself as well as the internal plate.

To close the system the abovementioned operations must be performed backwards until the plate 1 is once again beside the bottom section bar 10. By exerting a slight force, orthogonal to the display counter, upon the plate 1, the pin 14 then slots into the bush 15 and the pin 19 is blocked once again in the lock's 18 catch mechanism.

The invention claimed is:

1. A dual motion opening system for a display unit having a plurality of plates, wherein each plate is glass or plastic, single or double, and each plate has a mechanical structure comprising:

a first section bar (3) that is fixed to a gripper that holds the plate (1);

a second section bar (10) that is connected to the display unit; and at least one first support arm (5, 5') and one second support arm (6, 6') that are hinged upon said section bars (3, 10) by supports (4, 4', 11, 11') and pins (7, 7', 12, 12'), said support arms (5, 5', 6, 6') differing in length;

wherein the mechanical structure is connected to display counter or window near a base of tank by fixing said second section bar (10) to the display counter or window or by fixing said second section bar (10) to a third section bar (9) that is in turn fixed to the display unit;

wherein said second support arm (6, 6') is longer than said first support arm (5, 5') and bears a feedthrough (6.1) near its end that fits the support (4') fixed to said first section bar (3) fixed to the gripper that holds the plate (1), said feedthrough (6.1) being large enough for the pin (7') of the support (4') to slide into;

wherein the system also contains a spring closing mechanism comprising a pin (14) around which a spring (14.2) is wrapped, and which fits into a bush (15), said pin (14) being fixed to a crop of said first section bar (3) that is in turn fixed to the gripper that holds the plate (1), said bush (15) being fixed to a crop of said second section bar (10) that in turn is fixed to the display counter or window or to said third section bar (9);

wherein the system also contains a lock (18) comprising a slot (18.1) with a catch mechanism including a pin (19), said pin (19) being connected to said first section bar (3) fixed to the plate (1), whereas said lock (18) is connected directly or indirectly to the display counter or window, said lock (18) being unblocked by a lever (20) that releases the catch mechanism of the lock (18).

2. The opening system according to claim 1, wherein said first section bar (3) fixed to the gripper that holds the plate (1) and said second section bar (10) connected to the display unit have the same profile, said second section bar (10) being the mirror image of said first section bar (3) when mounted.

3. The opening system according to claim 1, wherein both said first section bar (3) fixed to the gripper that holds the plate (1) and said second section bar (10) connected to the display unit contain guides (3.1, 10.1) to fit square nuts along one side, said guides having axes which are parallel to axes of said section bars (3, 10), and said guides having teeth (3.2, 10.2) along a side opposite the square nuts.

4. The opening system according to claim 3, wherein two of said supports (4, 4') are screwed into said first section bar (3) fixed to the gripper that holds the plate (1) using bolts (4.1) and nuts that are inserted into the guides (3.1) contained in said first section bar (3), and wherein two of said supports (11, 11') are screwed to said second section bar (10) connected to the display counter or window using screws (11.1) and nuts that are inserted into the guides (10.1) contained in said second section bar (10) said supports (4, 4', 11, 11') constituting hinge members upon which ends of support arms (5, 5', 6, 6') fit.

5. The opening system according to claim 4, wherein one end of said first support arm (5, 5') is fitted by a pin (7) bearing a nut (7.1) to a first support (4) fixed to said first section bar (3) fixed to the gripper that holds the plate (1), and wherein one end of said second support arm (6, 6') is fitted by a pin (7') bearing a nut to another support (4') fixed to said first mobile section bar (3).

6. The opening system according to claim 5, wherein an opposite end of said first support arm (5, 5') is fitted by a pin (12) bearing a nut (12.1) to one support (11) fixed to said second section bar (10) connected to the display unit, and wherein one end of said second support arm (6, 6') is fitted by a pin (12') bearing a nut to another support (11') fixed to said second section bar (10).

7. The opening system according to claim 6, wherein the ends of the support arms (5, 5', 6, 6') rest upon the supports (4, 4', 11, 11') that rest upon bronze bearings (8, 13) or upon axial bearings.

8. The opening system according to claim 3, wherein said first section bar (3) is joined to a fourth section bar (2) that constitutes part of the gripper, and wherein screws (3.3) acting upon inclined planes formed on said fourth section bar (2) permit said first section bar (3) to be tightened to said fourth section bar (2) so that the teeth (3.2) on said first section bar (3) are completely inserted into the guides on said fourth section bar (2) to avoid said first and fourth section bars (3, 2) becoming separated.

9. The opening system according to claim 3, wherein said second section bar (10) is joined to said third section bar (9) using screws (10.3) acting upon inclined planes formed on said third section bar (9) that permit said second section bar (10) to be tightened to said third section bar (9) 50 that the teeth (10.2) on said second section bar (10) are completely inserted into the guides on said third section bar (9) to avoid said second and third section bars (10, 9) becoming separated.

10. The opening system according to claim 9, wherein a top section bar (16) and a bottom section bar (17) are fixed using bolts (16.1, 17.1) and nuts to said third section bar (9) fixed to the display counter or window, wherein inserts (16.2) to accommodate electrical resistors are made into said top section bar (16), wherein a part of said top section bar (16) that points toward the plate (1) accommodates a base of one gasket (16.3) that rests against the plate (1), and wherein a part of said bottom section bar (17) that points toward said first section bar (3) connected to the gripper that holds the plate (1) accommodates a base of another gasket (17.2) that rests against the gripper that holds the plate (1).

11. The opening system according to claim 10, wherein said third section bar (9) is fixed to the display unit, and said top section bar (16) and said bottom section bar (17) are built in one single piece.

12. The opening system according to claim 1, wherein the plate (1) is fixed directly to said first section bar (3).

13. The opening system according to claim 1, wherein the section bars (3, 9, 10) and said support arms (5, 5', 6, 6') can be curved to allow for the motion of curved, spherical and cone frustum plates (1), and wherein a bend radius is equal to or greater than that of edge of the display counter or window's tank.

* * * * *